US006611994B2

(12) United States Patent
Bischofberger et al.

(10) Patent No.: US 6,611,994 B2
(45) Date of Patent: Sep. 2, 2003

(54) METHOD AND APPARATUS FOR FIBER LENGTH MEASUREMENT

(75) Inventors: Jürg Bischofberger, Räterschen (CH); Götz Theodor Gresser, Winterthur (CH); Olivier Wüest, Seuzach (CH); Christian Sauter, Flurlingen (CH); Jürg Faas, Andelfingen (CH); Peter Artzt, Reutlingen (DE); Volker Jehle, Ebersbach (DE); Hermann Maidel, Reutlingen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/887,518

(22) Filed: Jun. 22, 2001

(65) Prior Publication Data

US 2002/0152583 A1 Oct. 24, 2002

(30) Foreign Application Priority Data

Jun. 23, 2000 (CH) ..... 1243/00

(51) Int. Cl.[7] ..... D01G 15/00
(52) U.S. Cl. ..... 19/98; 19/105
(58) Field of Search ..... 19/98, 99, 100, 19/101, 102, 103, 104, 105, 106 R, 110, 111, 112, 113, 114, 236, 240; 73/159, 160

(56) References Cited

U.S. PATENT DOCUMENTS 4,075,739 A * 2/1978 Staheli ..... 19/240
4,271,565 A * 6/1981 Grunder ..... 19/105
4,275,483 A * 6/1981 Roberson ..... 19/105
4,279,060 A * 7/1981 Wirth ..... 19/106 R
4,384,388 A * 5/1983 Mondini ..... 19/105
4,438,548 A * 3/1984 Grunder ..... 19/105
5,052,080 A * 10/1991 Grundler ..... 19/105
5,361,458 A 11/1994 Demuth et al.
5,930,870 A * 8/1999 Leifeld et al. ..... 19/105
5,974,629 A * 11/1999 Leifeld et al. ..... 19/102

FOREIGN PATENT DOCUMENTS

DE 2912576 C2 10/1979
DE 8607052 U1 4/1999
EP 0383246 B1 8/1990
EP 0485881 B1 5/1992

OTHER PUBLICATIONS

EPO Search Report, Jul. 29, 2002.

* cited by examiner

*Primary Examiner*—Gary L. Welch
(74) *Attorney, Agent, or Firm*—Dority & Manning

(57) ABSTRACT

The present invention relates to the application of fiber length measurement in the blowroom or carding room of a spinning mill. A method and an apparatus in a textile processing machine are described in which before and/or after a working element of the textile processing machine the nep count and/or the fiber length (staple) is determined, with an open-loop/closed-loop control unit being provided which receives the values for the fiber length and/or the nep count as input and determines therefrom the optimized machine setting data and outputs the same to at least one actuator of a working element which influences the nep count and/or the staple of the textile processing machine.

16 Claims, 7 Drawing Sheets

METHOD AND APPARATUS FOR FIBER LENGTH MEASUREMENT

BACKGROUND

Figure 1:
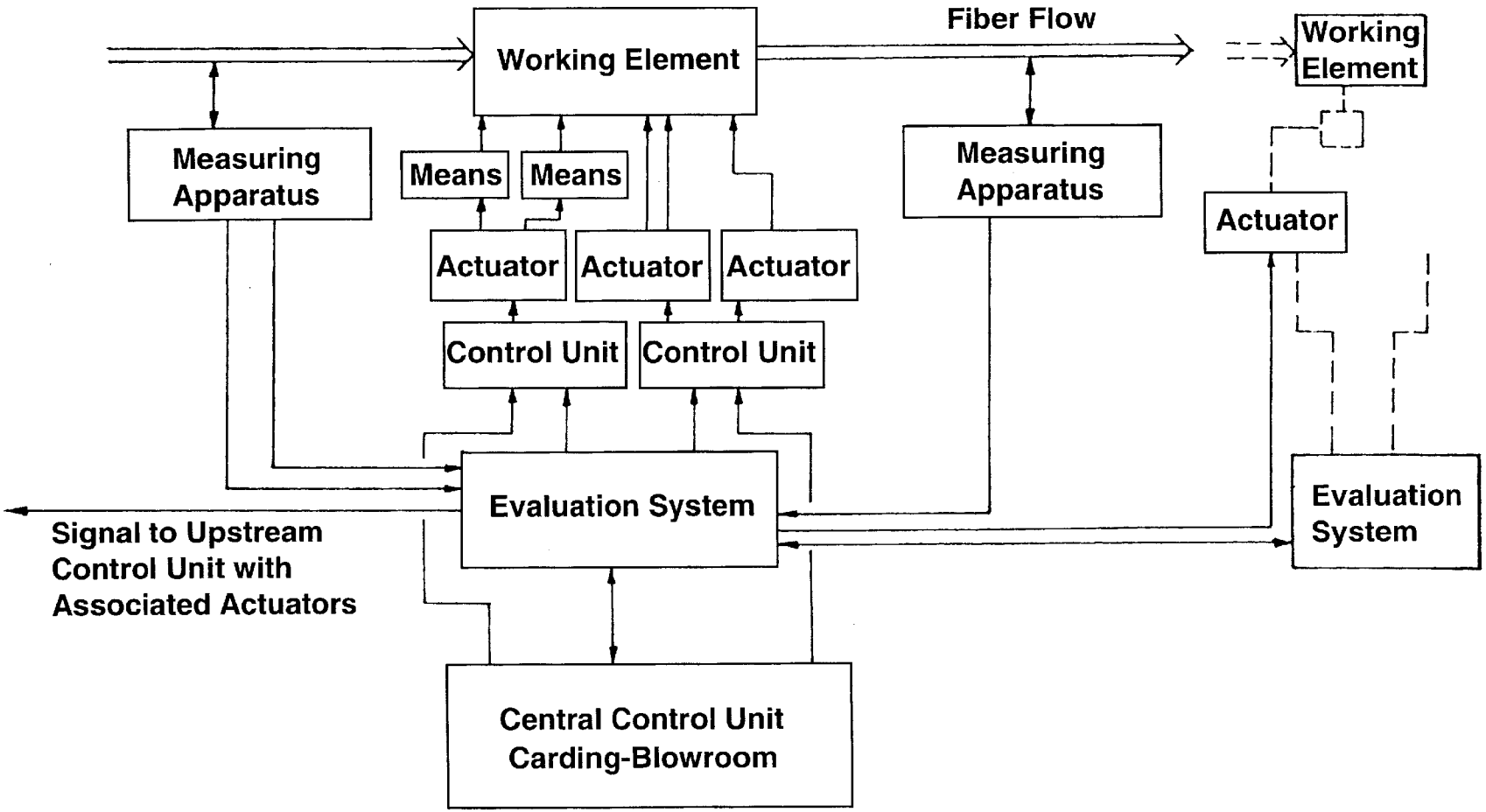

The present invention relates to the application of fiber length measurement in the blowroom or carding room of a spinning mill. In conventional blowroom lines and in the subsequent carding room the same textile fibers, e.g. cotton, chemical fibers or mixtures thereof (assortments), are often processed over prolonged periods of time. The settings of the textile processing machines are usually only adjusted to or optimized once for the respective assortments of the material and then not changed any more. Such adjustments of operating parameters are usually cumbersome and require a relatively high amount of time. For the new setting of optimal operating parameters of the production line it may be necessary under certain circumstances to take samples of fiber material at different locations and to analyze the same partly with complex and time-consuming measuring methods in the laboratory (e.g. the measurement of the shortening of the staple fiber, nep count, share of short fibers). Textile processing plants with the aforementioned adjusting possibilities therefore come with the disadvantage that smaller (temporal) deviations in the processed fiber material qualities cannot be considered, which results in respective quality losses in the end products of the process stage (e.g. shortening of the staple fiber). This occurs because on the one hand one is not able to perform a sufficiently quick measurement in order to determine the deviation and, on the other hand, because a new setting of the machine would take too long. An additional factor is that it is currently no longer economically viable to adapt a blowroom or a carding room to only one specific fiber material right from the start. Blowrooms are currently designed for the purpose of processing different types of materials (assortments). A rapid new setting of the textile processing machine or adaptation to the new material to be processed is therefore an advantage. This requirement of rapid adjustability of the blowroom line and the carding room additionally increases the aforementioned disadvantages of a conventional textile processing line.

The textile industry has recognized these problems to a certain extent. In DE-A-196-51-893 a method and an apparatus are described in which the staple fiber length and the nep count is measured in a carding machine. The determined measured values are used for setting the operating parameters of the carding machine. The nep count figures and the fiber length distribution are determined for the optimization of the production and linked with one another. An open-loop or closed-loop counter defines the optimal operating parameters on the basis of said linkage. The measurement is performed on-line (measurement of the staple diagram and nep count). The following two operating parameters (actuating variables) are adjusted: The distance of the clothings from the flat and the swift (carding gap) and the speed of the swift. The control or determination of the optimal setting values is made on the basis of stored data fields of characteristics/characteristic curves which also contain the pertinent machine setting data. The input data are compared with these data fields of characteristics/characteristic curves. The fiber samples require for the analysis are sucked off. Suction can be performed according to this specification at the following locations: at the doffer, at the stripping roller, at the crushing rollers or at the licker-in. The staple which is measurable online is measured with the help of a fibrograph (fiber tuft curve).

Specification DE-A-196-51-891 further describes a method and an apparatus in which the fiber staple is measured twice. Partial quantities of the fibers are taken at the entrance and the exit of the carding machine (e.g. they are sucked off). The fiber shortening amount is determined from the differential values of the measurement. Depending on the value, the working elements which influence the carding gap are newly set or optimized (influencing the carding intensity). The taking of fiber samples occurs at the following places: at the doffer, at the stripping roller, before or after the crushing rollers, on the swift or licker-in. The samples are evaluated automatically and online, i.e. the staple diagram is determined from the values. The evaluations are used as input data for the open- and closed-loop control devices which determine the optimal machine setting data. The optimal machine setting data concerning the carding gap are sent online to the working elements or actuators of the carding machine which control the distance between the clothings of the cylinder and the flat. The open- and closed-loop control devices also comprise stored characteristic curves in this case too. A fibrograph and a fiber shortening sensor are provided for the fiber length measurement.

SUMMARY

The invention is based on the object of providing a method and an apparatus which, among other things, eliminates the aforementioned disadvantages and further improves the processing of fibers both in the carding room as well as the blowroom. Additional objects and advantages of the invention will be set forth in the following description, or may be obvious from the description, or may be learned through practice of the invention.

The object is achieved by the characterizing features of the claims. The method in accordance with the invention and its apparatus allow controlling the processing of fibers or flocks in an optimal way. This means that the fibers or flocks are processed as optimally as possible by maintaining the lowest possible damage to the fibers (fiber shortening) or nep formation. In addition, the apparatus in accordance with the invention and its method allow a rapid and automatic adjustment of the fiber processing to fluctuations in the fiber material quality (fluctuations caused by different material quality or properties of the individual fiber bales) and to fiber materials to be newly processed (i.e. acceleration of the adjustment of the machines to assortments to be newly processed).

Such improvements in the blowroom and carding room lines are enabled by the features of the claims in accordance with the invention. The measurement of fiber material properties (in particular online measurement), their evaluation and the respective influence of certain actuators (see below) constitute further additional important measures for the realization of the invention.

The invention accordingly provides a method and an apparatus in a textile processing machine, in particular in a blowroom machine or carding machine, in which the nep count and/or the fiber length (staple) is measured and evaluated before and/or after a working element. A nep sensor and a fiber-length measuring apparatus are provided respectively and perform the measurements (with the fiber-length measuring apparatus taking a small fiber quantity as a sample). In addition an open-/closed-loop control unit is provided which receives the measured values for fiber length and/or nep count from the sensors as input values and determines therefrom the optimized machine setting data. The open-/closed-loop control unit also works here preferably with stored data fields of characteristics or data records. The specific machine setting data or parameters are output to one or several actuators influencing the nep count and/or the fiber staple of the textile processing machine. This can be understood insofar as several actuators can also be controlled in combination in order to change one or several settings of the machine. It is also possible in a further embodiment of the inventive idea that the measurements are performed on a working element, whereas the influenced actuators belong to another upstream or downstream working element, which means that actuators of other textile processing machines are also understood as being among the same. A very important element of the invention is that the open- or closed-loop control can be performed on-line and automatic, i.e. during the operation without any outside influence by the operating personnel. Semi-automatic variants are naturally also possible in which the sensors or the control unit will draw the operating staffs attention to any recommendable adjustment of the operating parameters and the latter only need to agree to such an adjustment by pressing a button for example.

Particularly important for the application of the invention on carding machines is, in addition to the aforementioned features, that the actuators change at least one of the following settings: The nipping distance between the feeding trough and the licker-in, or its nip force, the rotating speed of the licker-in, or the rotating speeds thereof (in the case of several licker-ins), the transfer factor (which can be changed by individual actuators or by a combination thereof), the production of an individual working element or of the entire textile processing machine (in respect of the carding machine this means in particular the delivery speed of the sliver or the sliver weight) as well as the angular position and the distance of the stripping or separating knives.

Particularly important for the application of the invention in blowroom machines is, in addition to the aforementioned features, that the actuators change at least one of the following settings: the rotational speed of the cleaning or opening rollers, the position and angle of the grid, the position and angle of the stripping or separating knives, the nipping distance or nip force of the draw-in rollers to the feeding trough of the respective cleaning or opening roller.

The term blowroom machines is to be understood in particular as bale openers, fine and coarse cleaners, mixers and fiber tuft feederes or, more generally, all textile processing machines of the blowroom which are provided upstream of the carding room.

The inventive idea therefore comprises the following apparatuses, methods and purposes for use:

A method in a carding machine in which before and/or after a working element the nep count and/or the fiber length (staple) is determined, with an open-loop/dosed-loop control unit being provided which receives the said values for the fiber length and/or the nep count as input values and determines therefrom the optimized machine setting data and outputs the same to at least one actuator of a working element which influences the nep count and/or the staple of the carding machine, with at least one actuator changing the distance between the feed roller and the licker-in and/or the nipping distance and/or the nip force of the feeding trough at the licker-in. Working elements are understood as being in particular the feeding apparatus, the licker-in(s), the carding sections in the various carding zones (e.g. pre- and post-carding zone, fixed or revolving-flat carding zone), the swift, the doffer, the separating knives, the doffing apparatus, the regulating devices of the textile processing machines for inlet and outlet, or the entire textile processing machines for inlet and outlet, or the entire textile processing machine per se (e.g. a carding machine). The determination of the fiber length or staple as well as the nep count is performed by special measuring apparatuses and sensors which preferably allow an online evaluation. Such devices are known from the state of the art and are subject to a continuing further development. The measuring apparatuses shall not be discussed further herein because they are not the subject matter of the present invention.

The "nipping distance" is understood as being the distance between the nip point between feeding trough and feed roller (i.e. the outermost and narrowest nip point between the trough and the feed roller at the outlet of the trough) and the first licker-in. The term "nip force" can be regarded as the force or pressure which acts between the feeding trough and the feed roller.

Furthermore, a method in a carding machine in which before and/or after a working element the nep count and/or the fiber length (staple) is determined, with an open-loop/closed-loop control unit being provided which receives the values for the fiber length and/or the nep count as input values and determines therefrom the optimized machine setting data and outputs the same to at least one actuator of a working element which influences the nep count and/or the staple of the carding machine, with at least one of the actuators changing the rotational speed(s) of the lick-in or the actuator being a means influencing the transfer factor, or that at least one of the actuators changes the production of the carding machine, in particular the delivery speed or silver weight.

In order to change the rotational speed of the licker-in(s) it is possible to use a conventional belt gear. A frequency converter is preferably used, however. The term "transfer factor" indicates how many percent of the fiber mass disposed on the swift are transferred to the doffer during each rotation of the swift. A transfer factor of 20% indicates for example that 20% of the fibers on the swift move to the doffer during each rotation. In other words, each fiber rotates five times with the cylinder on the average (and is carded in this process) before it is grasped by the doffer. It is understood that the inventive idea also includes the possibility that the actuator which changes the transfer factor can consist of several means. Generally, the term "actuator" shall be understood in the entire specification as also comprising several devices or systems. An actuator could comprise for example several (mechanical) adjusting mechanisms with the associated motors and the associated frequency converters and electronic control units. The inventive idea also contains the fact that the transfer factor depends on several settings/parameters and therefore can also be influenced by several actuators. For example, during the change of the transfer factor it is possible that several actuators are involved, e.g. actuators which change the distances between licker-in and swift or swift and doffer, or actuators which can adjust the rotational speeds of swift or doffer (or the ratio between rotational speed of swift to rotational speed of doffer). The transfer factor is in addition influenced by further factors. This includes in particular the type of fiber, the set production and the type of clothings of the card as well as their sharpness. Further actuators can be used in accordance with the invention for all these factors. In particular, a sensor can determine the sharpness of the clothings and an actuator in accordance with the invention can improve the sharpness state of the clothings. The actuator can thus also represent a grinding apparatus or generally any other maintenance element. Such grinding apparatuses or maintenance elements are described in further specifications of the patentee.

The production of the card (i.e. fiber mass supplied as sliver per unit of time) is finally determined by the sliver weight, i.e. the weight per unit of length of the card sliver, and the delivery speed of the card sliver. The speed of the card sliver is on its part directly proportional to the circumferential speed of the doffer (one can assume in this case that the transfer factor remains unchanged). In most cases the doffer will be driven by a separate motor. The doffer can also be driven by the main drive motor by way of a belt drive. In this case, the ratio of the rotational speeds of swift and doffer remains constant when the transfer factor is to remain unchanged and the delivery speed is determined by the main drive of the carding machine. There is the desire in a carding machine to produce a sliver with a predetermined constant sliver weight, so that the sliver weight must not be changed. Since the production is equal to the delivery speed×sliver weight and the sliver weight should not be changed, the production is solely determined by the delivery speed and thus by the circumferential speed of the doffer. The sliver weight per se is determined by the weight of the lap feed and the basic draft, the ratio of the circumferential speed of the doffer to that of the feed roller (i.e. sliver weight equals lap weight multiplied by the effective draft of the carding machine). Under the condition of a constant sliver weight, the rotational speed of the feed roller is thus indirectly also determined by the circumferential speed of the doffer. In order to keep the sliver weight constant it has long been common practice in the field of carding machines to take measures in order to keep the lap weight (weight of lap per unit of length) constant in the feeding apparatus. Minor variations in the lap weight of the lap feed which is supplied to the feeding apparatus of the card are compensated with minor changes in the rotational speed of the feed roller (change of basic draft). Short-term fluctuations in the lap weight of the lap feed before or in the feeding apparatus of the card are detected by a respective measuring apparatus, whereupon the rotational speed of the feed roller is adjusted accordingly by way of an open-loop/closed-loop control unit (including the actuators). This open-loop/closed-loop control is known in the state of the art as short-term correction. In addition to this first possibility, a so-called long-term correction is mostly also provided. The long-term correction has the purpose, as mentioned above, of keeping the sliver weight as constant as possible. Usually, the sliver weight is measured at the output of the carding machine for the long-term correction and the circumferential speed of the feed roller is adjusted accordingly (i.e. the effective draft is regulated). In this way it is ensured that long-term deviations of the sliver weight can be compensated. Long-term correction is usually supplemented by short-term correction. This supplement is made, on the one hand, because long-term correction can only recognize deviations when they have already occurred and, on the other hand, because it is not capable of compensating short-term fluctuations in the lap weight due to the large distance between feed roller and doffer as well as the storage capacity of the swift. Examples of such open-loop/closed-loop control units and correction apparatuses are shown in the publications DE 29 12 576, EP 383 246 and U.S. Pat. No. 4,275,483 for example.

As mentioned above, the production of the carding machine is always controlled in practice by the delivery speed of the sliver, and hardly through the sliver weight (which should remain constant). The production of the carding machine also influences the quality of the sliver however, i.e. the delivery speed also has an influence on the sliver quality. These interactions must be taken into account by the control units. Apart from that, the rotational speeds of the rotating working elements (swift, licker-in, doffer, feed roller, etc.) must adjust to the delivery speed of the sliver. Frequency converters or similar transmissions which control the rotational speed of drive motors are used as actuators in such cases. The actuators can be controlled on their part by associated control units. These control units can perform their own evaluations and be connected both with the respective measuring apparatuses as well as with central control units which regulate and control the sequences and the production in the entire blowroom and carding room. It would also be possible, even though it would mostly not make any sense, to influence the production of the cards through the actuators which change the sliver weight. This could be appropriate in particular when the carding machine needs to process new assortments and as a result of later processing of the sliver other sliver weights are desired. A changeover of the carding machine to the new sliver weight would thus be quicker and easier to implement.

Up to this point it was always assumed in connection with influencing the production and the production quality of the carding machine that the transfer factor remains constant. This does not need to be so, however. It is naturally obvious and part of the inventive idea to combine influencing the production quality with the open-loop and closed-loop control of the transfer factor. As was already mentioned, the delivery speed can have an influence on the card sliver quality. In such a case it would be possible for example to compensate the losses in quality caused by increased production or higher delivery speeds by a respective influence of the basic draft and the transfer factor. It would be possible to change the aforementioned basic draft (which has an influence on the sliver weight) and to compensate the same by another transfer factor, so that in the end the sliver weight will remain constant, the carding process, however, will be gentler (lower shortening of the staple fiber). A further possibility of influencing the sliver weight is to change the lap weight in the fiber tuft feeder of the carding machine or to provide an additional delivery control or draw frame after the card delivery zone which drafts the sliver to the desired sliver weight. Further combinations are also possible with actuators influencing the nep count or the staple. These actuators can also be located within other textile processing machines which are disposed upstream or downstream of the carding machine.

The method in accordance with the invention therefore also includes the possibility to output the optimized machine setting data to at least one actuator which influences the nep count and/or the staple and is disposed upstream or downstream of a textile processing machine, in particular to an actuator of an upstream blowroom machine as well as to an actuator of a fiber tuft feeder provided upstream of the carding machine (influencing the lap feed by the fiber tuft feeder). The term "actuator" also comprises the associated means.

The invention also generally comprises the idea of providing a method in a blowroom machine for processing textile fibers in that the nep count and/or the sliver length (staple) is determined before and/or after one or several working elements and that optimized machine setting data are generated therefrom.

Similarly, an open-loop/closed-loop control unit can be provided which receives the values for fiber length and/or nep count as input values and determines therfrom optimized machine setting data. For this purpose the optimizer machine setting data can be output to at least one actuator of the blowroom which influences the nep count and/or the staple, in particular to an actuator of the same blowroom machine or an upstream or downstream textile processing machine.

The application of the inventive idea in a blowroom machine also includes the possibility that at least one of the actuators changes the rotational speed of the cleaning or opening roller or that at least one of the actuators changes the position or angle of the grid or that at least one of the actuators changes the nipping distance and/or nip force of the feeding trough to the cleaning or opening roller. The definition of the nipping distance and the nip force in these machines is analog to those of the feeding apparatuses of the carding machine as explained above.

The term "blowroom machine" can be understood as being a cleaner, in particular a fine or coarse cleaner, or a bale opener.

It can also be provided in connection with the method in accordance with the invention that the open-loop/closed-loop control determines the optimized machine setting data on the basis of predetermined or stored data fields of characteristics or data records. It is understood that the listed methods in accordance with the invention in a textile fiber processing plant can also be applied in combination with one another, which is why the combinations of the individual methods in accordance with the invention are claimed for the patentee.

The described methods also comprise in accordance with the invention the respective apparatuses:

For example an apparatus in a textile fiber processing machine in particular a carding machine in which the nep count and/or the fiber length (staple) is measured and evaluated before and/or after at least one working element, with an open-loop/closed-loop control unit being provided which according to one of the aforementioned methods receives the values for fiber length and/or nep count as input values and determines therefrom the optimized machine setting data and outputs the same to at least one actuator influencing the nep count and/or fiber length (staple), with the influence actuator(s) changing at least one of the following operating parameters: the nipping distance and/or the nip force of the feeding trough on the licker-in, one or several licker-in speeds, the transfer factor, the production of the carding machine, in particular the delivery speed or the sliver weight, the distance or angular position of the stripping knives.

In a further apparatus in accordance with the invention in a blowroom machine for processing textile fibers (in particular in bale openers, fine or coarse cleaners, or fiber tuft feeders), it is provided that the nep count and/or the fiber length (staple) is determined before and/or after at least one working element and optimized machine setting data are determined therefrom.

Similarly, an open-loop/closed-loop control unit can be provided in the apparatus which receives the values for fiber length and/or nep count as input values according to one of the aforementioned methods and determines therefrom optimized machine setting data.

An apparatus as described above can be equipped in such a way that the optimized machine setting data are output to at least one actuator influencing the nep count and/or the fiber length (staple), in particular to an actuator of the same blowroom machine or an upstream or downstream textile fiber processing machine which changes at least one of the following operating parameters: the rotational speed of the cleaning or opening roller, the grid attitude or angle, the nipping distance and/or the nip force of the feeding trough to the cleaning or opening roller.

It is particularly advantageous for implementing the inventive idea that the fiber length measurement and/or the nep count measurement and their evaluation is provided during the operation, i.e. online, in the aforementioned methods or apparatuses.

Examples with respect to the possible implementations of the inventions are now explained in connection with the drawings. The examples illustrate only a few of the numerous possibilities for implementing the invention. The inventive idea and the claims are in no way limited to the embodiments shown in the figures.

DETAILED DESCRIPTION

Reference will now be made in detail to examples of the invention as illustrated in the figures. Each example is provided by way of explanation of the invention, and is not as a limitation of the invention. For example, features illustrated or described as part of one embodiment may be used with another embodiment to yield still a further embodiment. It is intended that the invention include these and other modifications and variations.

FIG. 1 schematically shows the fiber flow by a working element of the carding room or blowroom. The term "working element" may be understood as being both entire textile processing machines such as carding machines, cleaners in the blowroom, etc., as well as individual elements of a textile processing machine such as licker-ins, feeding apparatuses, carding sections (stationary or in the revolving flat), swift, maintenance elements, doffers, delivery controls, separating and stripping knives, grid rods, opening and feed rollers, air evacuation and suction systems, etc. The measuring apparatuses which are connected to the textile fiber flow upstream or downstream to the working element can measure properties of the textile fibers. These can be individual or several properties such as the fiber or staple fiber length (measurement of individual fibers is preferred) or the nep count. The measuring apparatuses are only shown schematically, i.e. the apparatuses can also comprise several sensors which simultaneously measure several fiber properties. The applied measuring technology actually plays no role for the invention. It is also possible, however, that the measuring apparatus determines the fiber properties optically or takes small fiber samples from the fiber flow for measurement. The results of the measurement are sent by the measuring apparatus to an evaluation system. This evaluation system is capable of determining optimized setting values or parameters of the working element. This can occur, for example, by stored data records or data fields of characteristics. Under certain circumstances this evaluation system is connected with further similar evaluation systems. This is particularly of advantage where there can be interactions with other working elements, e.g. in working elements of the same textile processing machine. It is also possible under certain circumstances that the evaluation systems are connected with a central control unit which controls the production of the entire blowroom and carding room. The central control unit can in this case have an influence on the evaluation systems or their output signals. The evaluation systems can emit signals to individual or several control units which are connected with actuators. These actuators may under certain circumstances even belong to upstream or downstream working elements. The actuators exert an influence on the processing of the fibers in the working element. The "actuators" may under certain circumstances consist of several means, e.g. of a gear and a drive motor.

Figure 2:
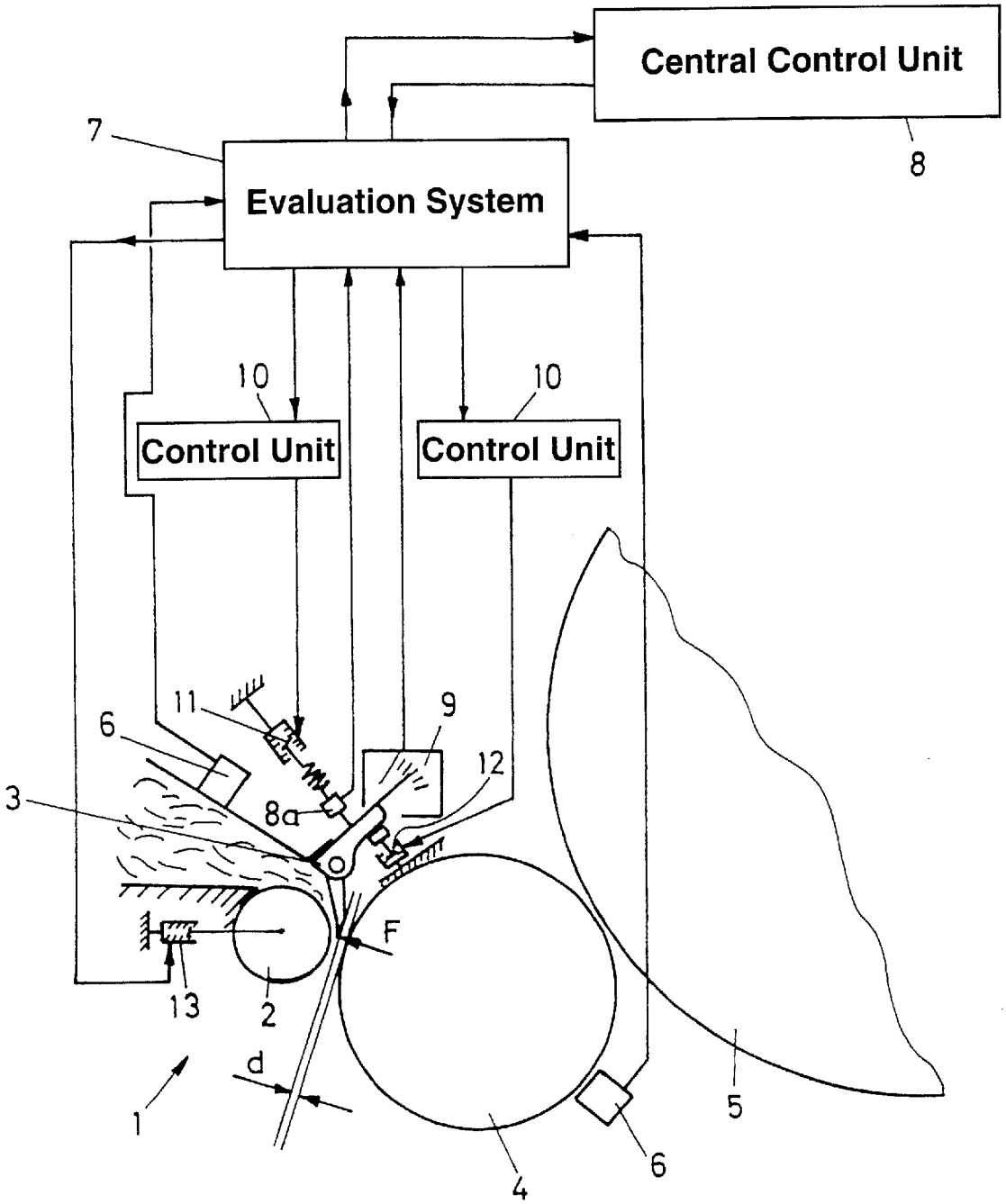

FIG. 2 shows a possible application of the apparatus and method in accordance with the feeding apparatus of a carding machine. The conventional feeding apparatus I guides the fiber material to a licker-in 4 by way of a feed roller 2 and a swivelable and adjustable feeding trough 3. The fiber material is supplied from there to the cylinder 5 of the carding machine. It is understood that apparatuses are also possible with several (e.g. three) licker-ins. In this apparatus, which is shown here as an example, measuring apparatuses 6 are provided at two places where fiber samples are taken and analyzed. The measuring apparatuses per se are not the subject matter of the invention. As is shown in FIG. 2, they can consist of individual units or of a central measuring apparatus which can take fiber samples at several places. The measuring apparatus measure individual or several fiber properties. For example, a measuring apparatus could consist of a combination of sensors which can measure the fiber length (staple) and the nep count. The two measuring apparatuses 6 send the determined fiber properties to an evaluation system 7. The evaluation system 7 is capable of determining from the obtained parameters the respective optimal operating parameters of individual or several working elements. It therefore also assumes the local open-loop and closed-loop control of these working elements. It is also possible that the individual measuring apparatuses 6 are integridd in the evaluation system 7. In this example, the evaluation system 7 is also in connection with the central control unit 8 which can influence the evaluation system 7 and its output signals. This central control unit 8 can concern the central control unit of the entire blowroom or carding room system or only the central control unit of the respective machine. The central control unit 8 can be in connection with several such evaluation systems 7 and coordinate the cooperation (not shown in the figure). The evaluation system 7 also detects in this example the nip force F of the feeding trough on the feed roller via a sensor 8*a*, as also the nipping distance d via a sensor 9. The evaluation system 7 determines on the basis of the mentioned input values the optimal operating parameters, which in this example are the nipping distance d, the nip force F and the distance between feed roller and licker-in. The signals representative of the optimal operating parameters are output at the output of the evaluation system 7 to the control units 10 of actuators 11 and 12 or directly to actuator 13 (actuators are shown schematically). The control units 10 detect the input signal and set the triggered actuators 11 and 12 to the correct values. Actuator 11 is used for setting the nip force F, whereas actuator 12 can change the nipping distance d. The distance between the feed roller and the licker-in is controlled by the evaluation system 7 directly through actuator 13. The precise technical cooperation between evaluation system, control unit and actuator system is not relevant for the invention. The presence of a central control unit is also not mandatory for the invention. The relevant aspect is that the evaluation system determines the respective machine setting data and sends the same respective actuators which influence the nep count and/or the staple of the machine.

Figure 3:
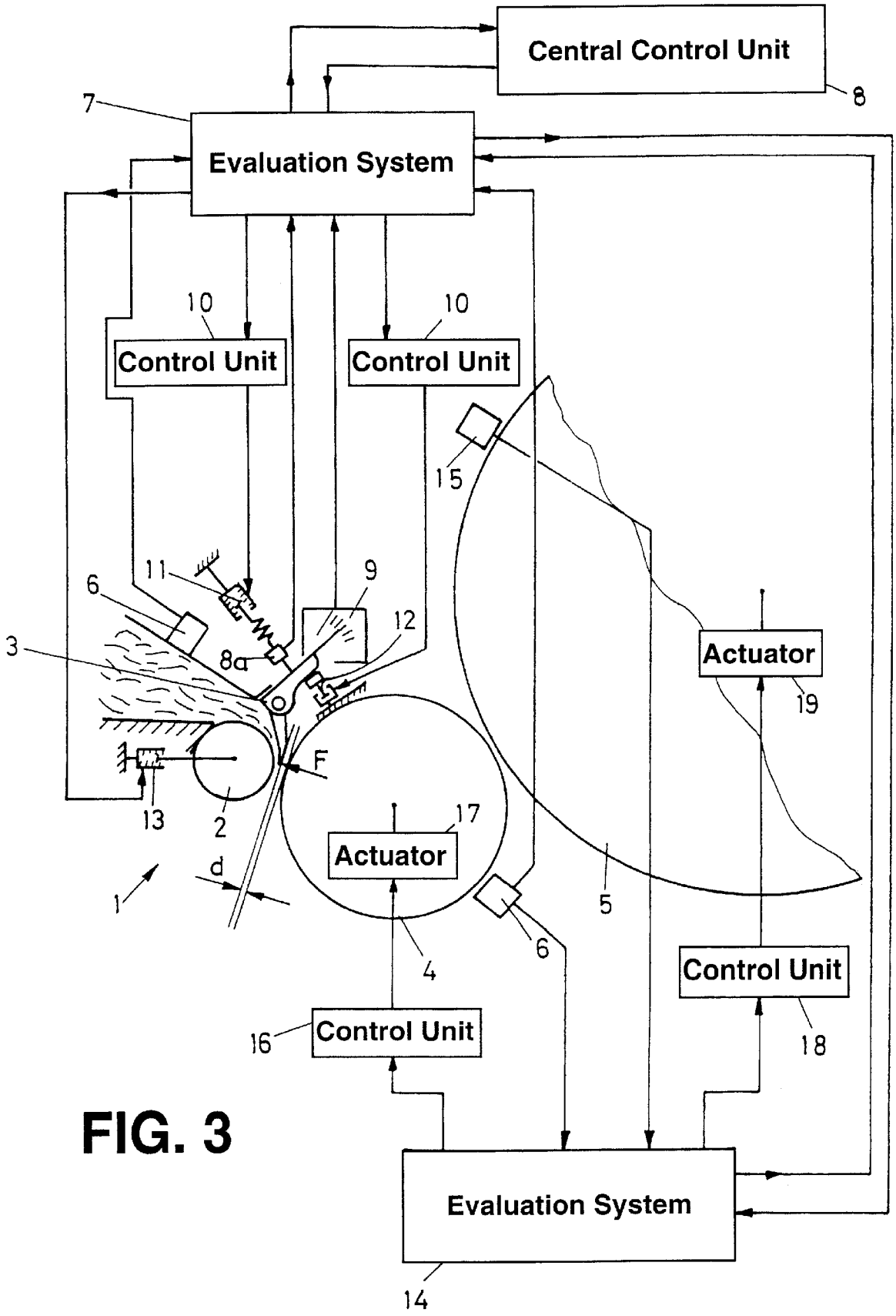

FIG. 3 is largely identical with FIG. 2. It was merely supplemented by a further application of the apparatus in accordance with the invention. The extension comprises a further evaluation system 14 in the example according to FIG. 3. Said evaluation system 14 is connected on the one hand with the same measuring apparatus 6 on the licker-in 4 as the evaluation system 7. It obtains the same measured values from the same. On the other hand, the evaluation system 14 is connected with a second measuring apparatus 15 on cylinder 5. The evaluation systems 14 and 7 are also connected with one another. They mutually exchange data and can therefore be in interaction with one another. The evaluation system 14 optimizes the rotational speed of the licker-in 4 by way of a control unit 16 (e.g. a frequency converter) and an actuator 17 (drive). This primarily occurs on the basis of the measured values which the evaluation system receives from the measuring apparatuses 6 and 15. Secondly, the evaluation system 14 will adjust the rotational speed of the licker-in 4 also on the basis of the signals which it receives from the evaluation system 7. In the example of FIG. 3 the two evaluation systems 7 and 14 are coupled with one another, but only the evaluation system 7 is connected with the control unit 8. It is naturally also possible in a further embodiment that the individual evaluation systems are not directly connected to one another, but that instead all are connected through the central control unit 8. The central control unit can engage in the optimization process of the individual evaluation systems and influence the same. It is the task of the central control unit to fine-tune the entire system and coordinate the evaluation systems.

The evaluation system 14 is also capable according to FIG. 3 of adjusting the rotational speed of the cylinder 5 by way of a further control unit 18 (e.g. further frequency converter) and an actuator 19 (e.g. electromotor). This adjustment can also apply on the one hand to the optimization of the operating parameters. On the other hand, the change can also only cause a simple production adjustment. For this purpose it is necessary that the evaluation system 14 is directly or indirectly connected (as shown in FIG. 3) with the central control unit. The central control unit can thus not only coordinate the interaction between the individual evaluation systems (e.g. predefining the processing quality), but also control the production.

Figure 4:
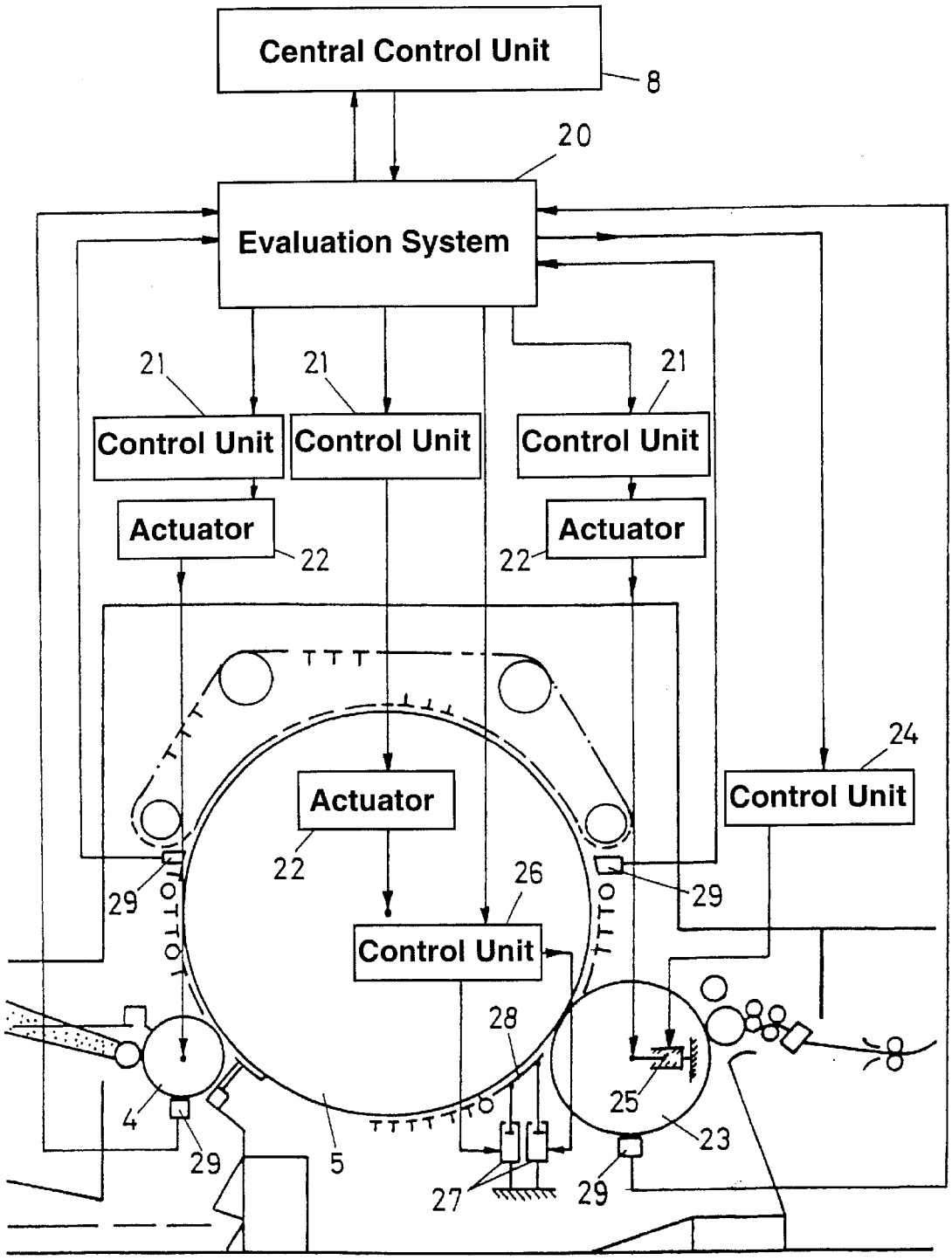

FIG. 4 shows a further application of the invention in a carding machine in which primarily the transfer factor is optimized. An evaluation system 20 is connected by way of several control units 21 with the actuators 22 which control the rotational speeds of the licker-in 4, the cylinder 5 and the doffer 23. The evaluation system 20 can in addition set the distance between doffer 23 and cylinder 5 by means of the control unit 24 and the actuator 25 (only shown schematically). Such an apparatus can also be provided with respect to the licker-in (not shown for purposes of clarity of the illustration), i.e. a control unit and one or several actuators allow setting the distance between the licker-in 4 and the cylinder 5. A further control unit 26 is provided which can set the position of the fiber-air guide element 28 by means of actuators 27 (also only shown schematically). The controlled working elements all have an influence on the transfer factor. The evaluation system 20 controls the setting of these working elements, so that an optimal influence on the transfer factor is produced. The evaluation system 20 is connected here too with the central control unit 8 and with several measuring apparatuses 29 which can determine the nep count and/or the fiber length. Since the production of the machine (processed fiber quantity per unit of time) has an influence on the transfer factor, the production requirement of the central control unit 8 also influences the transfer factor. The evaluation system 20 can compensate this influence if necessary by a necessary adjustment of the working elements. The sensors 29 also allow in this case too a constant check of the fiber processing and thus a purposeful intervention of the evaluation system in case of any changes in the processing quality of the working elements.

Figure 5:
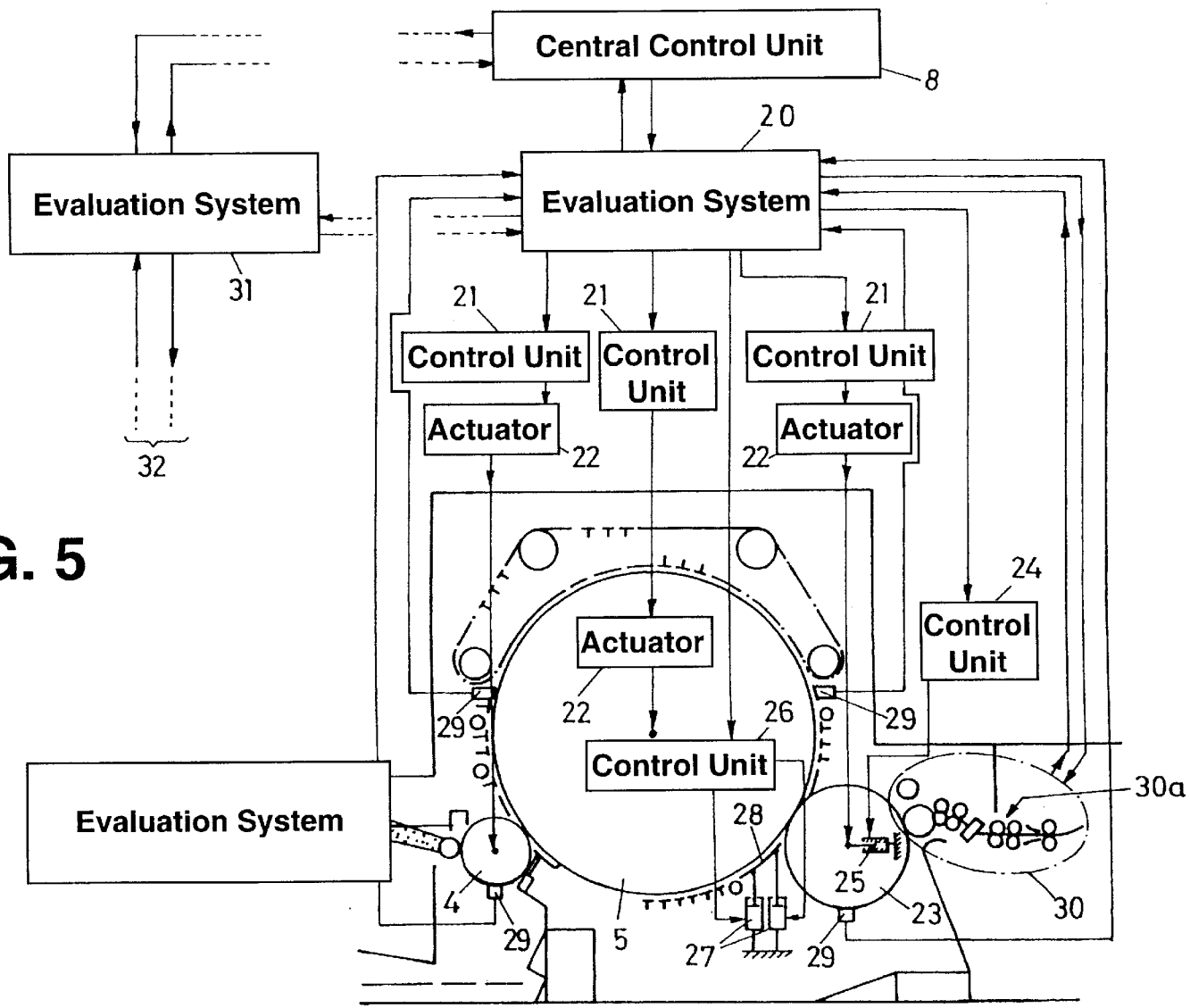

A further possibility for applying the invention is shown in FIG. 5. The example substantially corresponds to that of FIG. 4, only that the evaluation system 20 is connected with the delivery apparatus 30. The delivery apparatus 30 regulates the sliver delivery and the weight of the sliver at the delivery of the carding machine. It is only shown schematically in FIG. 5, because it is also not subject matter of the invention. The evaluation system 20 also receives the measured values transmitted from the delivery apparatus 30 (e.g. the sliver weight or the CV value). Respective control units and measuring apparatuses are regarded here as a part of the delivery apparatus 30 and were therefore not shown in FIG. 5. It is also possible that the delivery apparatus 30 is directly connected with the central control unit 8 and not, as shown in FIG. 5, via the evaluation system 20. Moreover, the evaluation system 20 and the central control unit 8 are also directly connected with a further evaluation system 31. The evaluation system 31 controls and regulates working elements through the schematically shown connections 32, which working elements are provided upstream of the shown carding machine. The evaluation system 31 can also belong to an upstream blowroom machine (e.g. an opener, a cleaner, a coarse cleaner, a fine cleaner, a de-duster, a mixer) or a fiber tuft feeder (which may also be equipped with additional opening and cleaning elements). The evaluation system 31 controls via connections 32 individual or several working elements of the associated textile processing machine (via actuators which are not shown).

In FIG. 5, the evaluation system 31 is provided upstream of the evaluation system 20. It is naturally also possible and part of the inventive idea that actuators of downstream textile processing machines can be influenced. The evaluation system 31 can similarly also be provided downstream of the evaluation system 20 and accordingly influence working elements of downstream textile processing machines.

Figure 6:
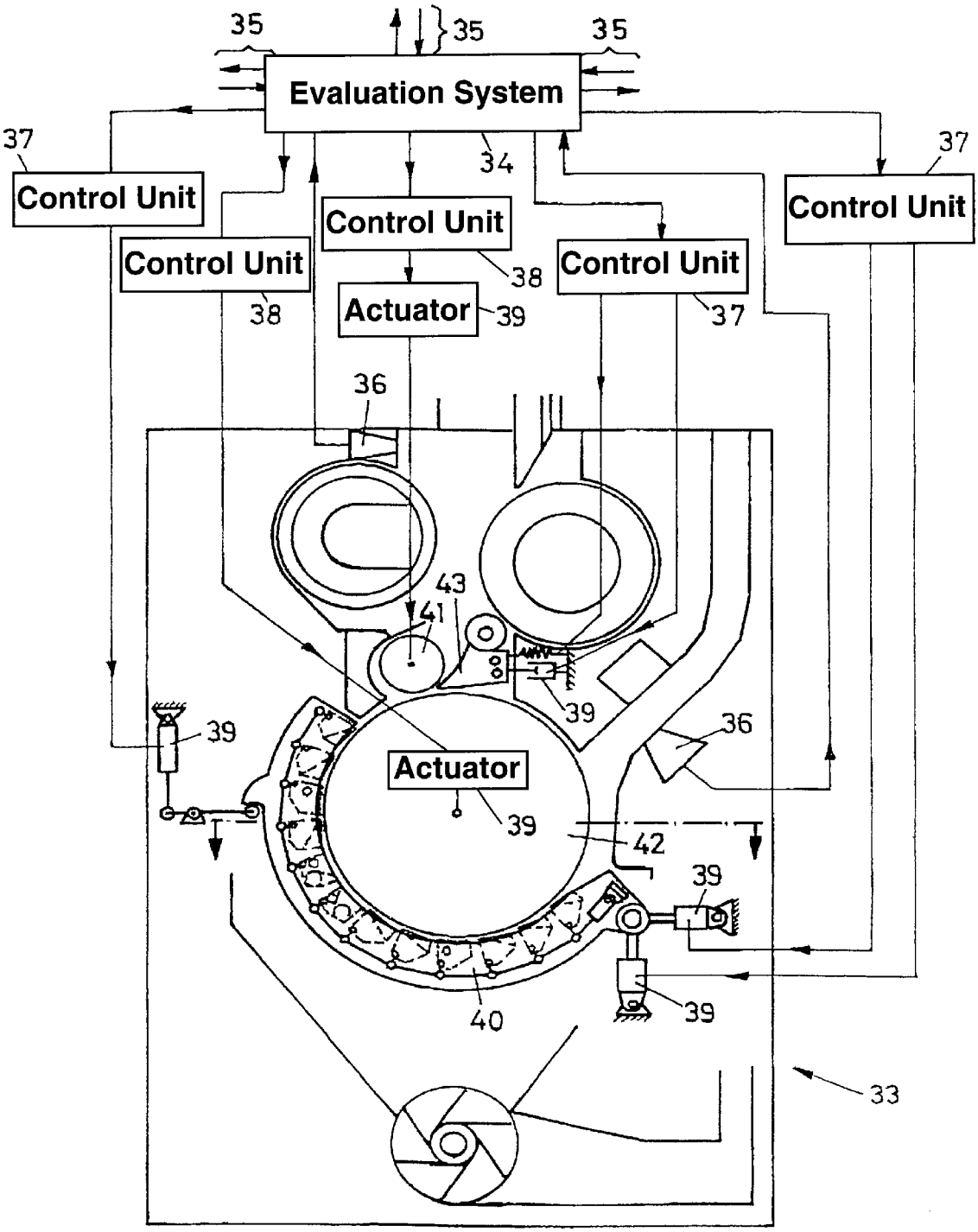

FIG. 6 shows the application of the invention in a blowroom machine. Although the blowroom machine 33 concerns a fine cleaner, the textile processing machine in FIG. 6 could similarly well represent a coarse cleaner or any other machine in the blowroom. The inventive principle can principally be applied to all blowroom machines (therefore also to openers, fiber tuft feederes, de-dusting machines, and mixers) and is therefore also claimed for these fields of application. In the blowroom machine 33 an evaluation system 34 also assumes the optimization of the operating parameters. The system 34 can exchange data via lines 35 with the upstream or downstream evaluation systems as well as with a central control unit (not shown) and can be influenced by the same. As a result of these connections, the evaluation system 34 becomes part of a network for optimizing the fiber processing. In this case too, the evaluation system receives measured values from the measuring apparatuses 36 which can be disposed before and after one or (as shown here) several working elements. The various evaluation systems of an installation can also use the measuring apparatuses together. The evaluation system 34 jointly evaluates the measured values received from the apparatuses 36 and the signals received through lines 35. This can occur on the basis of data fields of characteristics, data records and other methods. Thereafter the determined optimal machine setting data and values are sent via control units 37, 38 to actuators 39 which set the working elements accordingly. The said actuators 39 can change in the illustrated blowroom machine the nipping distance and nip force of the feeding trough 43, the rotational speed of the feed roller 41, the rotational speed of the cleaning and opening roller 42, the grid position (angle) of grid 40. The definition of the terms "nipping distance" and "nip force" has already been made above. They must be applied analogously (opening roller 42 instead of the licker-in).

Figure 7:
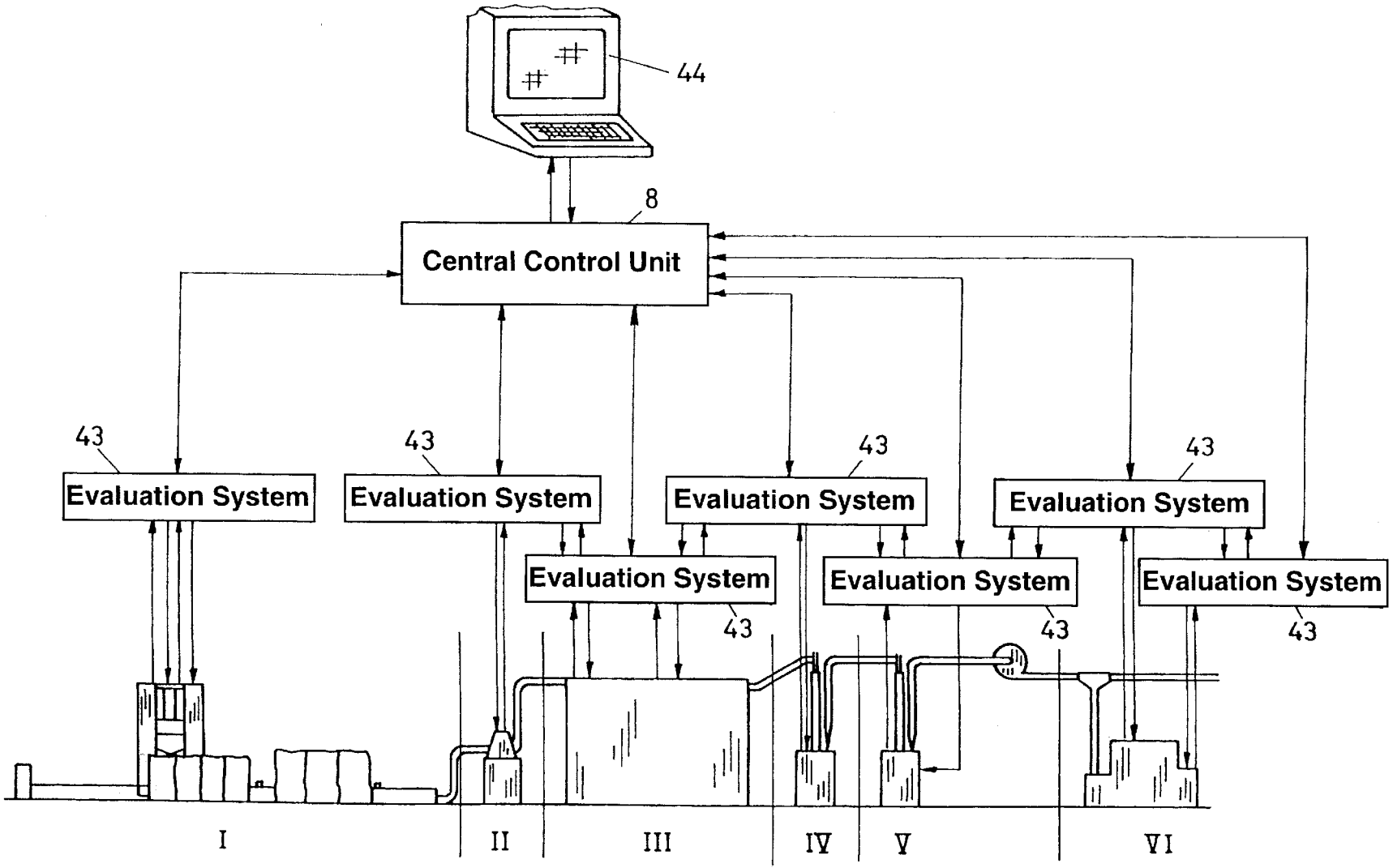

The last FIG. 7 schematically shows a possible composed blowroom line with a connected carding room. Individual machines can correspond to the preceding figures, but can also depart therefrom. In the shown example the blowroom comprises different processing stages: I. the opening, II. the coarse cleaning, III. the mixing, IV. the fine cleaning, V. an intensive cleaning or opening and VI. the carding. Each of these processing stages comprises at least one textile processing machine which comprises one or several evaluation systems 43. The evaluation systems 43 each evaluate the data which they receive from the measuring apparatuses in the textile processing machines (not shown) or of upstream or downstream evaluation systems. The evaluation is also influenced by the signals of the central control unit 8. The evaluation systems 43 control and regulate the associated working elements (only shown schematically through the connecting lines) as a result of the received input values and set the optimal machine settings. The evaluation systems 43 are linked among one another. This is made, on the one hand, in order to coordinate the respective machine settings or the processing intensity of the fibers and, on the other hand, in order to obtain measured values (fiber length or nep count) of upstream or downstream measuring apparatuses. The evaluation systems are also connected with the central control unit 8. Its primary task is to check and coordinate the entire system of the evaluation systems. It can also pre-select the parameters to be observed by each evaluation system and influence the same for the optimization of the entire blowroom line. Secondly, it can also control the production (the fiber quantity per unit of time) of the entire line. The central control unit can communicate with the operating staff of the unit by way of a monitoring system 44. The operating staff can enter the default values for the fiber processing for the entire unit or for individual machines via the monitoring system 44. This system can also notify the operating staff of adjustments needed in the operating parameters or of quality fluctuations of the processed fiber material. It is also possible to link the monitoring system 44 also with other data and information systems or to integrid the same therein. The data and information system "SPIDERweb" of the applicant is hereby mentioned as an example.

The inventive idea can be implemented in a particularly favorable manner when the processes as described in the figures occur "online". This means that the measurements, evaluations and controls occur on an ongoing basis during operation. The goal is to maintain the lowest possible response time between the occurrence of a change in the fiber flow (or fiber property) and the suitable influence made on the working element(s). A relevant factor is constituted by the performance of the measuring apparatuses: the faster they are able to measure and evaluate a fiber property, the shorter will be the entire response time of the system.

The invention is not limited to the explicitly mentioned possibilities and embodiments. These variants are to be understood more as suggestions for the person skilled in the art in order to implement the inventive idea in the most favorable manner possible. It is therefore easily possible to derive from the described embodiments further advantageous applications and combinations which also reflect the inventive idea and are to be protected by this application. Many of the features as disclosed in the description are claimed in a combined manner in the following claims. It would also be possible to claim individual features of the description per se.

What is claimed is:

1. A method for controlling a carding machine, comprising:

determining at least one of the parameters of fiber length and nep count before or after a working element in the carding machine in the direction of flow of fiber material through the carding machine;

inputting the parameter as an input value to a control unit;

with the control unit, determining optimized machine settings based on the parameter input value for at least one working element of the carding machine that influences the selected parameter and outputting the machine settings as an output value to at least one actuator of the respective working element; and based on the output value, varying the feed setting of the carding machine as a function of the output value by changing at least one of distance between a feed roller and licker-in, a nip distance between a feeding trough and the licker-in, and the nip force between the feeding trough and licker-in.

2. The method as in claim 1, wherein the step of inputting the parameter as an input value to a control unit comprises inputting the value to an open loop control unit.

3. The method as in claim 1, wherein the step of inputting the parameter as an input value to a control unit comprises inputting the value to a closed-loop control unit.

4. The method as in claim 1, further comprising outputting the optimized machine setting to at least one additional actuator that influences the selected parameter of nep count or fiber length, the additional actuator being at least one of an upstream blowroom machine and a fiber tuft feeder provided upstream of the carding machine.

5. The method as in claim 1, further comprising determining the optimized machine settings with the control unit based on stored data relating to characteristics of the respective working element.

6. The method as in claim 1, wherein the steps of determining the parameter of fiber length or nep count and determining the optimized machine settings are carried out during normal operating production of the carding machine.

7. A method for controlling a carding machine, comprising:

determining at least one of the parameters of fiber length and nep count before or after a working element in the carding machine in the direction of flow of fiber material through the carding machine;

inputting the parameter as an input value to a control unit;

with the control unit, determining optimized machine settings based on the parameter input value for at least one working element of the carding machine that influences the selected parameter and outputting the machine settings as an output value to at least one actuator of the respective working element; and based on the output value, changing the speed of the carding machine's licker-in with the respective actuator.

8. A method for controlling a blowroom machine, the blowroom machine being of the type disposed operationally upstream of carding machines and being any one of a fine cleaner, coarse cleaner, bate opener, fiber tuft feeder, mixer, or de-dusting machine, comprising:

determining at least one of the parameters of fiber length and nep count before or after a working element in a blowroom machine in the direction of flow of fiber material through the blowroom machine;

inputting the parameter as an input value to a control unit;

with the control unit, determining optimized machine settings based on the parameter input value for at least one working element of the blowroom machine that influences the selected parameter and outputting the machine settings as an output value to at least one actuator of the respective working element.

9. The method as in claim 8, wherein the step of inputting the parameter as an input value to a control unit comprises inputting the value to an open loop control unit.

10. The method as in claim 8, wherein the step of inputting the parameter as an input value to a control unit comprises inputting the value to a closed-loop control unit.

11. The method as in claim 8, wherein the optimized machine settings are also output to at least one additional working element actuator of a textile fiber processing machine upstream or downstream of the blowroom machine.

12. The method as in claim 8, comprising changing rotational speed of a cleaning or opening roller of the blowroom machine with the respective working element and actuator receiving the output values.

13. The method as in claim 8, comprising changing grid attitude or angle of cleaning elements in the blowroom machine with the respective working element and actuator receiving the output values.

14. The method as in claim 8, wherein the blowroom machine is a fine or coarse cleaner.

15. The method as in claim 8, wherein the blowroom machine is a bale opener.

16. The method as in claim 8, wherein the steps of determining the parameter of fiber length or nep count and determining the optimized machine settings are carried out during normal operating production of the blowroom machine.

* * * * *